US010386166B2

(12) United States Patent
Thomas

(10) Patent No.: US 10,386,166 B2
(45) Date of Patent: Aug. 20, 2019

(54) ANTI-VIBRATION MOUNTING SYSTEM

(71) Applicant: Atlantic Inertial Systems Limited, Plymouth, Devon (GB)

(72) Inventor: Henry James Thomas, Plymouth (GB)

(73) Assignee: ATLANTIC INERTIAL SYSTEMS LIMITED, Plymouth, Devon (GB)

( * ) Notice: Subject to any disclaimer, the term of this patent is extended or adjusted under 35 U.S.C. 154(b) by 0 days.

(21) Appl. No.: 15/555,684

(22) PCT Filed: Mar. 4, 2016

(86) PCT No.: PCT/GB2016/050568
§ 371 (c)(1),
(2) Date: Sep. 5, 2017

(87) PCT Pub. No.: WO2016/139483
PCT Pub. Date: Sep. 9, 2016

(65) Prior Publication Data

US 2018/0080749 A1 Mar. 22, 2018

(30) Foreign Application Priority Data

Mar. 5, 2015 (GB) ..... 1503729.4

(51) Int. Cl.
*F42B 30/00* (2006.01)
*F42B 15/08* (2006.01)

(52) U.S. Cl.
CPC ..... *F42B 30/006* (2013.01); *F42B 15/08* (2013.01)

(58) Field of Classification Search
CPC .... F42B 12/365; F42B 12/382; F42B 12/385; F42B 15/08; F42B 30/00; F42B 30/006; F16F 15/08; F16F 15/085
(Continued)

(56) References Cited

U.S. PATENT DOCUMENTS 5,890,569 A * 4/1999 Goepfert ..... G01C 21/16 188/378
6,578,682 B2 * 6/2003 Braman ..... F16F 15/08 188/378

(Continued)

FOREIGN PATENT DOCUMENTS

EP 1788277 A2 5/2007
FR 2050235 A1 4/1971

(Continued)

OTHER PUBLICATIONS

GB Search Report for Application No. GB1503729.4, dated Aug. 27, 2015. 3 pages.

(Continued)

*Primary Examiner* — James S Bergin
(74) *Attorney, Agent, or Firm* — Cantor Colburn LLP

(57) ABSTRACT

A mounting system for mounting an electronic component (2) in a housing (8) comprises a visco-elastic damping element (14, 20) for damping the transmission of vibration from the housing (8) to the component (2) in use, and a support (24, 52) for supporting the component (2) in the housing (8) independently of the damping element (14, 20) whereby the weight of the component (2) is substantially or completely removed from the damping element (14, 20). The support (24, 52) is configured to be selectively releasable from the component (2) such that the component (2) is then supported only by the damping element (14, 20).

16 Claims, 3 Drawing Sheets

(58) Field of Classification Search
USPC ..... 102/473, 501, 293, 379, 499
See application file for complete search history.

(56) References Cited

U.S. PATENT DOCUMENTS

| | | | | |
|---|---|---|---|---|
| 8,037,821 | B2 * | 10/2011 | Dietrich | F16F 3/093 102/200 |
| 8,931,765 | B2 * | 1/2015 | Braman | B81B 7/0016 267/136 |
| 2008/0217465 | A1 | 9/2008 | Facciano et al. | |
| 2009/0289400 | A1 | 11/2009 | Dietrich | |

FOREIGN PATENT DOCUMENTS

| | | | |
|---|---|---|---|
| WO | 2009142740 | A1 | 11/2009 |
| WO | 2013083959 | A1 | 6/2017 |

OTHER PUBLICATIONS

International Search Report for Application No. PCT/GB2016/050568, dated Jun. 2, 2016 3 pages.
Written Opinion for Application No. PCT/GB2016/050568, dated Jun. 2, 2016 5 pages.

* cited by examiner

ANTI-VIBRATION MOUNTING SYSTEM

CROSS REFERENCE TO RELATED APPLICATIONS

This is a US National Stage of Application No. PCT/GB2016/050568, filed on Mar. 4, 2016, which claims the benefit of GB Application No. 1503729.4 filed Mar. 5, 2015, the disclosures of which are incorporated herein by reference.

TECHNICAL FIELD

The present disclosure relates to the mounting of components, in particular electronic components, in projectiles.

BACKGROUND

It is frequently necessary to protect components, for example electronic components, such as inertial measurement units, from vibration in use, for example when such components are incorporated in projectiles. It has been found that to provide the necessary protection, the components require an anti-vibrational mounting. Such a mounting may comprise very soft materials which may have the disadvantage that they may creep under the weight of the component being supported. The rate of creep will depend on temperature and time. Thus, for example, if a unit is being stored for prolonged periods prior to use and/or at elevated temperatures, the damping material may creep and deform to such an extent that when used, it no longer performs its damping function appropriately.

SUMMARY

From a first aspect, the disclosure provides a mounting system for an electronic component in a housing, comprising a damping element for damping the transmission of vibration from the housing to the component in use, and a support for supporting the component in the housing independently of the damping element whereby the weight of said component is substantially or completely removed from the damping element, the support being configured to be selectively releasable from the component such that the component is then supported only by the damping element.

Thus in accordance with this disclosure, the weight of the component is removed from the damping element by means of a separate support. This avoids creep of the damping element. However, the support is selectively releasable from the component such that in use the damping element may only be supported by the damping element, thereby isolating the component from potentially damaging vibration.

In the context of a projectile, such as a munition, the support may be configured such that it is released automatically upon launch or firing of the projectile. This will allow the component to be suitably supported during storage and transportation, but then allow the appropriate vibration damped support for the component during the flight phase of the projectile.

As will be understood, during launch or firing, a projectile will experience high accelerations (for example up to 20,000 G) and thus components within the projectile will be subject to high forces. These forces, it has been realised, may be used to effect the release of the support, since the forces will result in the relative movement of the component and the housing.

In embodiments of the disclosure, therefore, the support is collapsible or permanently deformable in response to a predetermined movement of the component relative to the housing.

It has been found that during launch or firing, the forces exerted on and the movement of the component will generally be along the axial direction of the projectile, so in embodiments the support is configured to be deformable or collapsible in an axial direction. However, forces may also be generated in a radial direction or indeed in other directions. Accordingly, the support may be configured in addition, or alternatively, for deformation in a radial or other direction.

It has also been found that during firing or launch the inertial force exerted by and the movement of the component will be in the direction opposite to the launch direction, but that thereafter the component may rebound, thereby creating a force and movement of the component in an opposite direction. Also, the elastic compression of the projectile is released after launch which creates a transient shock condition, also in an opposite direction. In certain embodiments, therefore, the support comprises a first element which is deformable or collapsible in response to movement of the component in a first direction relative to the housing and a second element which is deformable or collapsible in response to movement of the component in a second, opposite direction relative to the housing.

In certain embodiments, the support comprises first and second support elements which are spaced apart, for example axially, along the component, the first support element being collapsible in response to movement of the component in the first direction and the second support element being collapsible in response to movement of the component in the direction. The respective support elements may be arranged at respective ends of the component.

The particular shape and construction of the support elements will depend upon the shape and arrangement of the component. In one embodiment, however, the support element may comprise a plurality of fingers which engage and support the component, but which are plastically deformed upon the movement of the component by the predetermined amount.

The fingers may be configured to be deformed either radially inwardly or outwardly depending on the particular installation. In one embodiment one support element is configured such that the fingers deform radially inwardly and the other support element such that the fingers deform radially outwardly.

The fingers may be mounted to a common base element which is mounted either to the housing or the component, and the fingers may be arranged in a circumferential array around the base element. The particular configuration of the fingers, their number and so on may be chosen to suit the particular material used and the loads applied.

In embodiments, the fingers are arranged in an axisymmetric manner so as to ensure uniform deflection of the fingers.

In one embodiment one support element, for example that at the lower end of the component is mounted to the housing, and the other support element, for example that at the upper end of the component, mounted to the component.

The fingers may have a bent shape with a first, generally axially extending portion for engaging a radially facing surface of the component or the housing, and an inclined portion engaging an axially facing surface or edge, for example an end surface or edge, of the component or housing. Movement of the component relative to the housing will then deflect and thereby plastically deform the inclined portion of the finger, thereby releasing the component from the support element.

The damping element may be provided at any convenient location between the component and the housing. In one embodiment, the damping element is disposed between opposed axially facing surfaces of the housing and the component. In other embodiments, however, the damping element may be arranged between radially facing surfaces of the housing. Respective damping elements may be provided at axially spaced locations along the component, for example at respective end regions of the component.

The or each damping element may comprise a damping body, for example a cylindrical damping body. The or each damping element may comprise a plurality of damping bodies, which may be mounted to a common support.

The particular design of damping element will depend on the damping required. In some embodiments, the damping element may be a visco-elastic damping element.

The damping element may be suitably attached to the housing, to the component or indeed to the support mounted to either of these components as appropriate, The mounting arrangement can be used in any part of a projectile. It may find particular application, however, in a tip portion of the projectile.

The component and mounting arrangement may be embodied in an assembly which is mountable to the projectile.

The component may be any component which requires vibrational damping, but in various embodiments it may be an inertial measuring unit.

DETAILED DESCRIPTION

Figure 1:
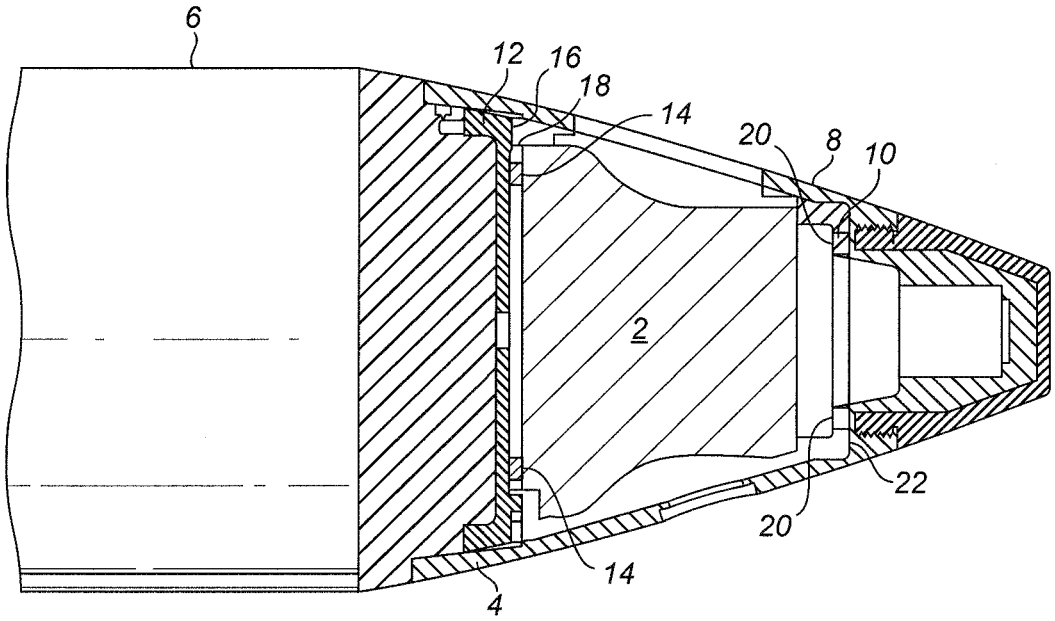
FIG. 1 shows an electronic component mounted at the tip of a projectile.

With reference to FIG. 1, an electronic component 2 is shown mounted in an assembly 4 mounted to a tip end of a projectile 6.

In this embodiment, the electronic component may be an inertial measurement unit which may be used for navigational purposes. However, the disclosure is not limited to such and extends to other electronic components as well.

The component 2 is mounted within a housing 8 of the assembly 4. The housing 8 has an annular shoulder 10 and a base 12 axially spaced from the annular shoulder 10. The component 2 is mounted between the annular shoulder 10 and the base 12. In use, the component 2 must be isolated from any vibration experienced by the housing 8 and to this end is provided with a first damping element 14 arranged between opposed axially facing surfaces 16, 18 of the base 12 and component 2 and a second damping element 20 arranged between the annular shoulder 10 and an axially forward facing surface 22 of the component 2. This will, in use, isolate the component 2 from vibrations in the projectile and housing 8.

In this embodiment, the first and second damping elements 14, 20 are visco-elastic damping elements, for example silicone or polyurethane dampers. However, the damping elements need not be visco-elastic and can be of any other construction or material which will provide an anti-vibrational damping effect.

The dampers 14, 20 may creep under the weight of the component 2 when the projectile or assembly 4 is being stored etc., particularly if they are of a relatively soft material, for example a silicone or polyurethane elastomer. Accordingly, the assembly 4 is provided with an additional support for the component 2 which will relieve the dampers 14, 20 of the weight of the component 2. This may be regarded as "caging" the component during storage, etc. Details of the support and its relationship to the dampers 14,20 will now be described in greater detail with reference to FIGS. 2 to 4.

Figure 2:
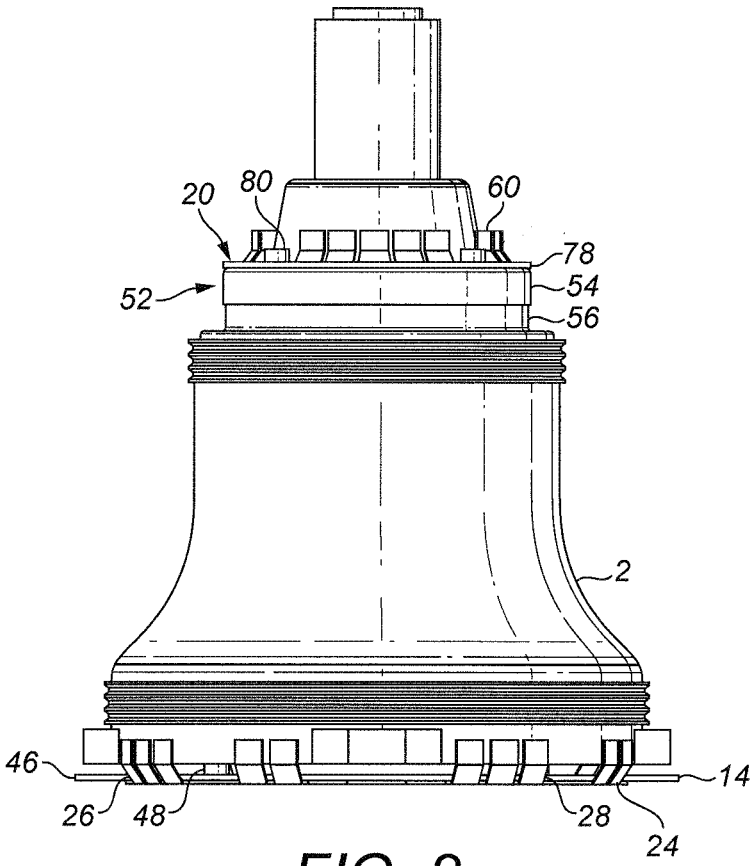
FIG. 2 shows the electronic component of FIG. 1 in more detail.

With reference to FIG. 2, the support comprises a first support element 24 which is mounted, for example bonded, to the axially facing surface 16 of the base 12 (shown in FIG. 1). The first support element 24 is formed as a generally annular element comprising an annular base 26 and a plurality of fingers 28 extending axially away from the first support base 26. The annular base 26 is generally flat for engagement with the axially facing surface 16 of the base 12.

Figure 3:
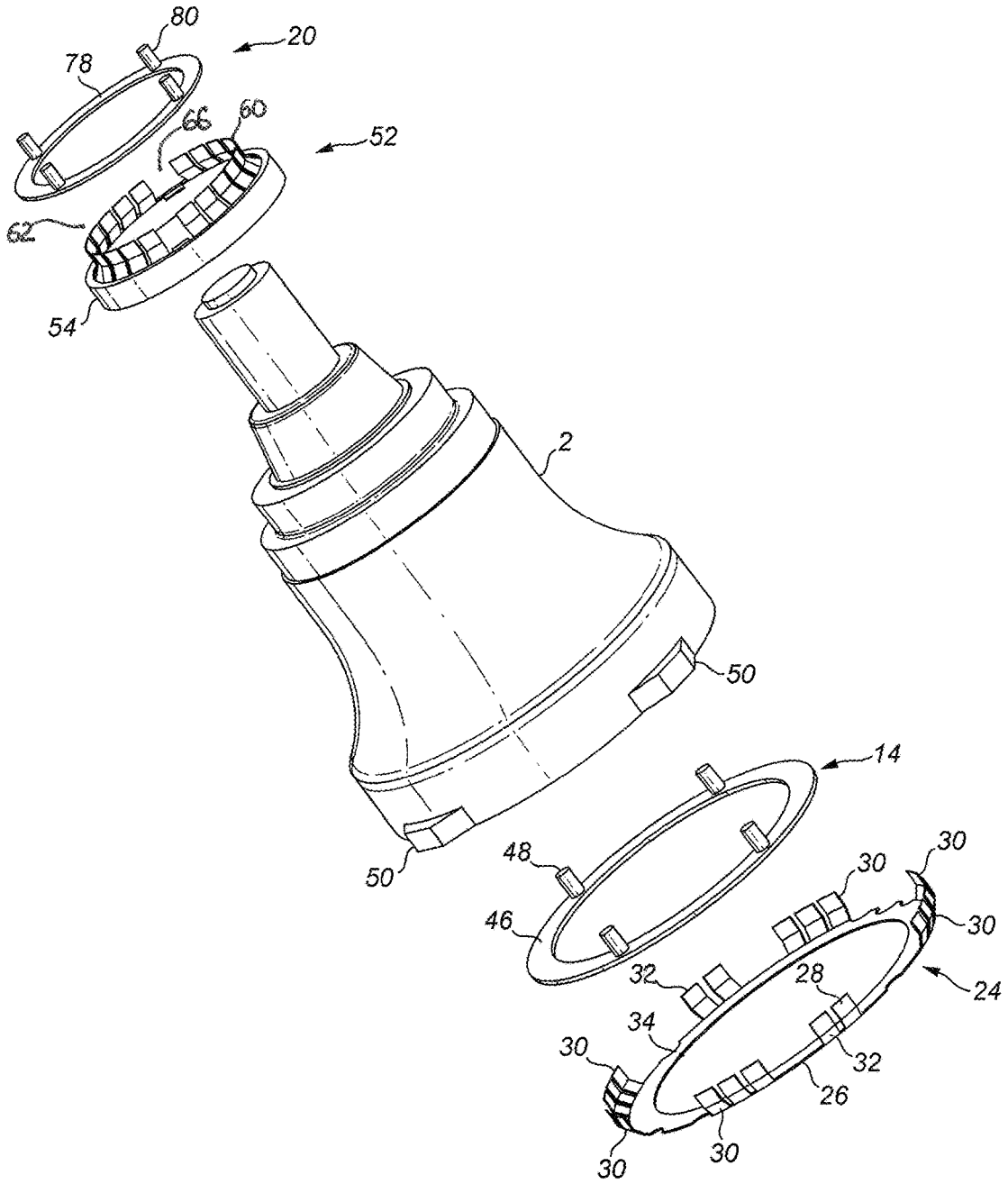
FIG. 3 shows the electronic component of FIG. 2 in an exploded view.

As will be seen from FIGS. 2 and 3, the fingers 28 are arranged axi-symmetrically circumferentially around the support base 26 in a plurality of groups. In this particular embodiment, the fingers 28 are arranged in six groups 30 each having three fingers 28 and two groups 32 of two fingers 28. Respective gaps 34 are formed between adjacent groups 30, 32 of fingers 28. The total number of fingers 28, the numbers of groups 30, 32 of fingers 28, and the number of fingers 28 in each group 30,32 and the arrangement of the groups can be chosen appropriately to the application and the component being supported.

Figure 4:
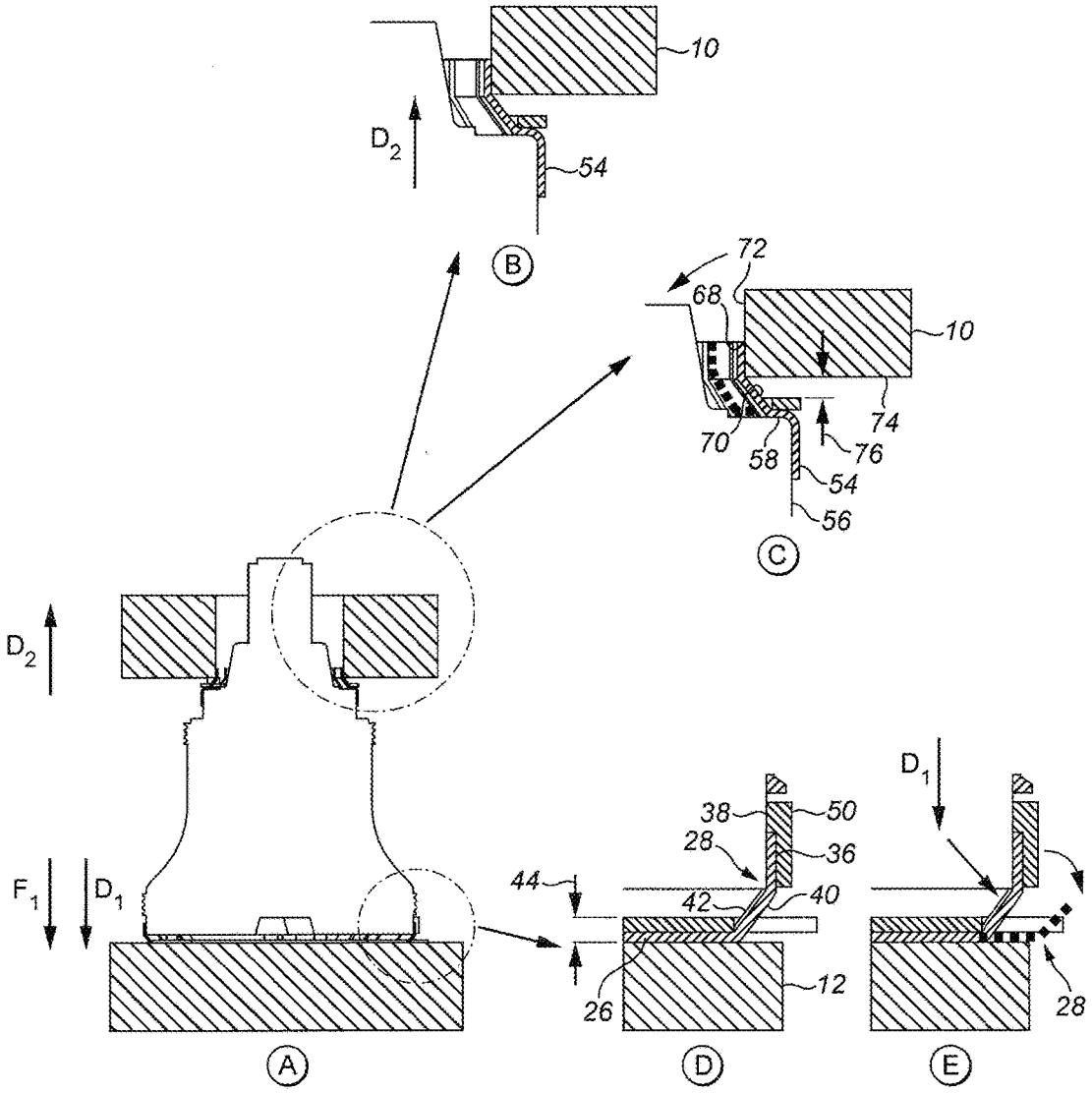
FIG. 4 illustrates the deformation of the support of the electronic component.

As can be seen from FIG. 4, each finger 28 is bent in shape. The finger 28 has a first, generally axially extending portion 36 which surrounds an axially extending peripheral surface 38 of the component 2. The finger 28 further comprises an inclined second portion 40 joining the support base 26 to the axially extending portion 36. A lower edge 42 of the component 2 engages the inclined portion 40 such that at rest, an axial gap 44 is formed between the opposing axially facing surface 16,18 of the base 12 and the component 2.

As will be seen from FIGS. 2 and 3, the first damping element 14 is received on the annular base 26 of the first support 24. In this embodiment, the damper 14 comprises an annular base member 46 from which extend a number of, in this embodiment 4, circumferentially spaced cylindrical damping elements 48. The number of damping elements 48 and their arrangement may be varied, depending on the particular application. As can be seen in FIG. 2, at rest, the damping elements 48 contact the axially facing surface 18 of the component 2. The base 46 of the damping element 14 may be secured to the first support 24 in any convenient manner, for example by bonding.

As can be seen from FIG. 2, one end of the component 2 is received within the fingers 28. The circumferential position of the component 2 is maintained by a plurality of locating elements 50 which engage in respective gaps 34 between the groups 30,32 of fingers 28. Moreover, the damping element 14 is arranged such that the damping elements 48 are aligned with the gaps 34 between the groups of fingers 28 so as not to interfere with the deformation of the fingers 28.

The support further comprises a second support element 52 mounted on the axially facing surface 22 of the component 2 (shown in FIG. 1). The second support element 52 is formed as a cap element, having a depending annular flange 54 which extends around an axially extending peripheral surface 56 of the component 2. It further comprises a planar annular base member 58 which sits on and is attached to the axially facing surface 22. A plurality of fingers 60 are arranged axi-symmetrically and extend axially away from the base member 58. In this embodiment, there are 4 groups 62 of 5 fingers. Respective gaps 66 are provided between adjacent respective groups 62 of fingers 28.

Similarly to the fingers 28 of the first support element 24, the fingers 60 of the second support element 52 comprise a first, generally axially extending portion 68 and a second, inclined portion 70 joining the first portion 68 to the annular base portion 58. As can be seen particularly in FIG. 4, the axially extending portion 68 of each finger will engage inside and axially extending opening 72 defined by the housing shoulder 10, with an axially facing surface 74 of the shoulder 10 engaging the inclined portion 70 of each finger 60, thereby creating a gap 76 between the axially facing surface 74 of the shoulder 10 and the annular base portion 58.

The second damping element 20 is secured to the upper surface of the annular base portion 58 of the second supporting element 52 for example by bonding. As can be seen in FIG. 3, similarly to the first damping element 14, the second damping element 20 comprises an annular base 78 and a plurality, in this embodiment 4, circumferentially spaced damping elements 80 extending axially away from the base 78. The number and spacing of the damping elements 80 may vary depending on the particular application. The damping elements 80 will contact the axially facing surface 74 of the housing shoulder 10 at rest.

Again the second damping element 20 is arranged such that the damping elements 48 do not to interfere with the deformation of the fingers 60.

The first and second support elements 24,52 are made from a deformable material, for example, a deformable metal. In this particular example, the support elements 24,52 are made from beryllium copper and have a thickness of approximately 0.3 mm. However, these are not limiting and the support elements may be made from any suitable material and have any suitable thickness which will allow the fingers 28,60 to deform as will be discussed further below. The support elements 24, 52 may be suitably constructed from a sheet material which is stamped and bent to the appropriate shape.

The first and second damping elements 14,20 may conveniently be moulded from an appropriate material, for example a silicone elastomer. It is not essential that the damping elements 14, 20 be formed as annular elements and a plurality of individual, un-connected elements could be provided. However by making the elements in one piece, their assembly and location in the construction is facilitated.

It will be understood from the above that when at rest, the support elements 24,52 support the component 2 in such a manner that no or minimal component weight, is transferred to the first and second dampers 14,20. The axially extending portions 36,68 of the fingers 28,60 support the component 2 in a radial direction, while the inclined portions 40,70 support the component 2 in an axial direction. In this situation, there is effectively no damping between the housing 8 and the component 2. However, that is not important since the component 2 is inoperative in these conditions and does not require damping.

In use, however, the component 2 must be vibrationally damped with respect to the housing 8. Therefore, the support provided by the first and second support elements 24,52 must be released to permit this damping. This is effected during launch or firing of the projectile 6.

With reference to FIG. 4, it will be understood that during projectile launch, an inertial force F1 will be created by the component 2. This will cause the component 2 to move in a direction D1 relative to the housing 8. This movement will tend to close the gap 44 between the opposed axially facing surfaces 16, 18 of housing base 12 and the component 2. The movement also causes the axially facing surface 18 of the component 2 to urge outwardly the inclined portion 40 of the respective support fingers 28. The material and construction of the fingers is such that plastic deformation of the fingers will take place such that the fingers 28 will deform to the shape shown schematically in FIG. 4E. From this it will be seen that the axially extending portions 36 of the fingers 28 have disengaged from the component 2 thereby releasing the component 2.

During the launch, a rebound effect occurs in combination with the release of elastic compression of the projectile after launch which means that the component 2 will then move axially forward in a direction D2. This movement of the component 2 moves the second support element 52 (which is mounted to the component 2) towards the housing shoulder 10, with the effect that the inclined portion 70 of the second fingers 60 engage the axially facing surface 74 of the housing shoulder 10 and deform inwardly to the position shown in FIG. 4C. In this position, the axially extending sections 68 of the fingers disengage from the bore 72 of the housing shoulder 10, thereby releasing the upper end of the component 2.

In the steady state flight condition, therefore, the only support between the component 2 and the housing 8 is by means of the first and second dampers 14,20. The first and second supports 24,52 do not interfere with the damping effect of the dampers 14,20 at this time. The act of launching the projectile automatically releases the supports 24,52, requiring no external action by an operator.

It will be understood that the above is a description of a non-limiting example and that various modifications to the particular embodiment described may be made without departing from the scope of the disclosure.

For example, in certain embodiments, it may be possible to provide a deformable support at only one location on the component. However, generally two support elements 24, 52 will be provided at axially spaced locations on the component 2.

In addition, the support elements 24,52 may be mounted to either the housing 8 or the component 2 depending on the particular installation. What is important is that the interaction between the housing 8, component 2 and the support elements 24,52 during launch acts to release the support elements 24,52.

Also, the numbers of fingers 28, 60, and their grouping may be varied depending on any structural features which may have to be avoided and which might otherwise prevent them from deforming as intended. It may, however, be desirable to have an axi-symmetric arrangement so as to achieve uniform deformation.

While described in the context of supporting an inertial measurement unit, the disclosure is applicable to the support of other components as well.

The invention claimed is:

1. A mounting system for mounting an electronic component (2) in a housing (8), the mounting system comprising:

a damping element (14, 20) for damping the transmission of vibration from the housing (8) to the component (2) in use, and a support (24, 52) for supporting the component (2) in the housing (8) independently of the damping element (14, 20) such that the weight of the component is substantially or completely removed from the damping element (14, 20), the support (24, 52) being configured to be releasable from the component (2) such that the component (2) is supported only by the damping element (14, 20) after the support has been released from the component, wherein the support (24, 52) is collapsible or permanently deformable upon a predetermined movement of the component (2) relative to the housing (8) so as to release the component (2).

2. A mounting system as claimed in claim 1, wherein the support (24, 52) is configured to be collapsible or permanently deformable in an axial and/or radial direction.

3. A mounting system as claimed in claim 1, wherein the support comprises a first support element (24) which is deformable or collapsible in response to movement of the component (2) in a first direction (D1) relative to the housing (8) and a second support element (52) which is deformable or collapsible in response to movement of the component (2) in a second, opposite direction (D2) relative to the housing (8).

4. A mounting system as claimed in claim 3, wherein first and second support elements (24, 52) are spaced apart axially along the component (2), the first support element (24) being collapsible in response to movement of the component (2) in the first direction (D1) and the second support element (52) being collapsible in response to movement of the component (2) in the second direction (D2), the respective support elements (24, 52) optionally being arranged at respective axial ends of the component (2).

5. A mounting system as claimed in claim 1, wherein the damping element (14, 20) is disposed between opposed axially facing surfaces (16, 18, 20, 22) of the housing (8) and the component (2).

6. A mounting system as claimed in claim 5, comprising first and second damping elements (14, 20) provided at axially spaced locations along the component (2).

7. A mounting system as claimed in claim 1, wherein the damping element (14, 20) comprises a plurality of damping bodies (48, 80), optionally mounted to a common support (46, 78).

8. A mounting system as claimed in claim 1, wherein the damping element is a visco-elastic damping element.

9. A mounting system for mounting an electronic component (2) in a housing (8), the mounting system comprising:

a damping element (14, 20) for damping the transmission of vibration from the housing (8) to the component (2) in use, and a support (24, 52) for supporting the component (2) in the housing (8) independently of the damping element (14, 20) such that the weight of the component is substantially or completely removed from the damping element (14, 20), the support (24, 52) being configured to be releasable from the component (2) such that the component (2) is supported only by the damping element (14, 20) after the support has been released from the component, wherein the support (24, 52) comprises a plurality of fingers (28, 60) which engage and support the component (2), but which are plastically deformed upon the movement of the component (2) by the predetermined amount.

10. A mounting system as claimed in claim 9, wherein the fingers (28, 60) are configured to be deformed either radially inwardly or outwardly.

11. A mounting system as claimed in claim 10, wherein the fingers (28) of one support element (24) deforming radially outwardly and the fingers (60) of a second support element (52) deforming radially inwardly.

12. A mounting system as claimed in claim 9, wherein the fingers (28, 60) are mounted to a common base element (26, 58) which is mounted either to the housing (8) or to the component (2).

13. A mounting system as claimed in claim 12, wherein the fingers (28, 60) are arranged in a circumferential array around the base element (26, 58), the array optionally being axi-symmetrical.

14. A mounting system as claimed in claim 9, wherein the fingers (28, 60) have a bent shape with a first, generally axially extending portion (36, 68) for engaging a radially facing surface (38, 72) of the component (2) or the housing (8), and an inclined portion (40, 70) engaging an axially facing surface or edge (16, 74), of the component (2) or housing (8).

15. A projectile (6) comprising:

a mounting system for mounting an electronic component (2) in a housing (8), the mounting system comprising:

a damping element (14, 20) for damping the transmission of vibration from the housing (8) to the component (2) in use, and a support (24, 52) for supporting the component (2) in the housing (8) independently of the damping element (14, 20) such that the weight of the component is substantially or completely removed from the damping element (14, 20), the support (24, 52) being configured to be releasable from the component (2) such that the component (2) is supported only by the damping element (14, 20) after the support has been released from the component;

wherein the support (24, 52) is collapsible or permanently deformable upon a predetermined movement of the component (2) relative to the housing (8) so as to release the component (2), and wherein the launching of the projectile (6) cause the release of acting to release the support (24, 52) from the component (2).

16. A projectile as claimed claim 15, wherein the mounting system is fitted in a tip portion of the projectile (6).

* * * * *